United States Patent [19]

Siefken

[11] 4,106,701

[45] Aug. 15, 1978

[54] DEVICE FOR PUNCTURING A HOLE IN A CAN AND WASHING THE INSIDE THEREOF

[76] Inventor: Larry O. Siefken, R.R. #1, Box 75, Palmer, Iowa 50571

[21] Appl. No.: 735,606

[22] Filed: Oct. 26, 1976

[51] Int. Cl.[2] ..... B05B 1/14

[52] U.S. Cl. ..... 239/271; 134/167 R; 141/329

[58] Field of Search ..... 239/271, 288, 288.5; 134/167 R, 168 R, 22 R; 141/329, 330, 19, 106, 364; 222/81, 88; 175/19, 21; 173/126; 30/443, 449; 47/48.5, 57.5

[56] References Cited

U.S. PATENT DOCUMENTS

| | | | |
|---|---|---|---|
| 2,355,513 | 8/1944 | Cox | 239/271 X |
| 2,491,516 | 12/1949 | Piggot et al. | 134/167 R X |
| 2,548,621 | 4/1951 | Rutledge | 239/271 |
| 3,050,095 | 8/1962 | Prather | 173/126 X |

*Primary Examiner*—Joseph F. Peters, Jr.
*Assistant Examiner*—Michael Mar
*Attorney, Agent, or Firm*—Zarley, McKee, Thomte, Voorhees & Sease

[57] ABSTRACT

An elongated nozzle having spray openings along its length has a funnel at one end with the other end being pointed. A hose connector is provided in the funnel optionally providing capability for wash water to be supplied through a hose or a wash container having a spout which may be received in the funnel. A guide-rod standard is connected to the funnel on top of the nozzle and a weight is slidably and removably positioned on the rod for being driven against the upper end of the funnel for driving the pointed end of the nozzle through the wall of a can. A guide portion of the rod extends parallel to the nozzle and engages the outside of the can wall to maintain the nozzle parallel to the can wall. A strap may be extended around the wash container to secure it to the guide-rod standard.

9 Claims, 5 Drawing Figures

DEVICE FOR PUNCTURING A HOLE IN A CAN AND WASHING THE INSIDE THEREOF

BACKGROUND OF THE INVENTION

Farm sprayers include large spray tanks which are filled with chemicals from five gallon cans mixed with water in the spray tank. It is important that these spray cans have all of the chemicals removed therefrom to avoid waste and environmental pollution and contamination. A convenient way is needed to puncture an opening in the chemical cans so that cleaning water may be introduced for washing the insides of the cans. The cleaning solution would then be utilized in the spray tank leaving a clean chemical can with no environmental pollution or contamination.

SUMMARY OF THE INVENTION

The device of this invention includes an elongated nozzle which has a pointed end with a funnel at the opposite end. The nozzle has spray openings along its length for spraying water or the like over the interior walls of a chemical can. The funnel feeds a cleaning solution into the elongated nozzle from either an inverted wash container having its spout in the funnel or a hose connected to the nozzle within the funnel. The pointed end of the nozzle is driven through the end wall of the chemical can by the force imparted to it when a weight movably carried on a guide-rod standard is dropped or forcibly driven against the upper end of the funnel which in turn transmits the force to the pointed end of the nozzle. A handle is provided on the weight for raising and lowering the weight. The lower end of the guide-rod standard is positioned in close relationship to the body of the nozzle such that a space is provided for the sidewall of the chemical can thereby maintaining the nozzle in a parallel relationship to the sidewall of the can. A strap may be extended around the wash container and the upstanding guide-rod standard to hold the wash container in position for being emptied into the funnel.

DESCRIPTION OF THE PREFERRED EMBODIMENT

Figure 1:
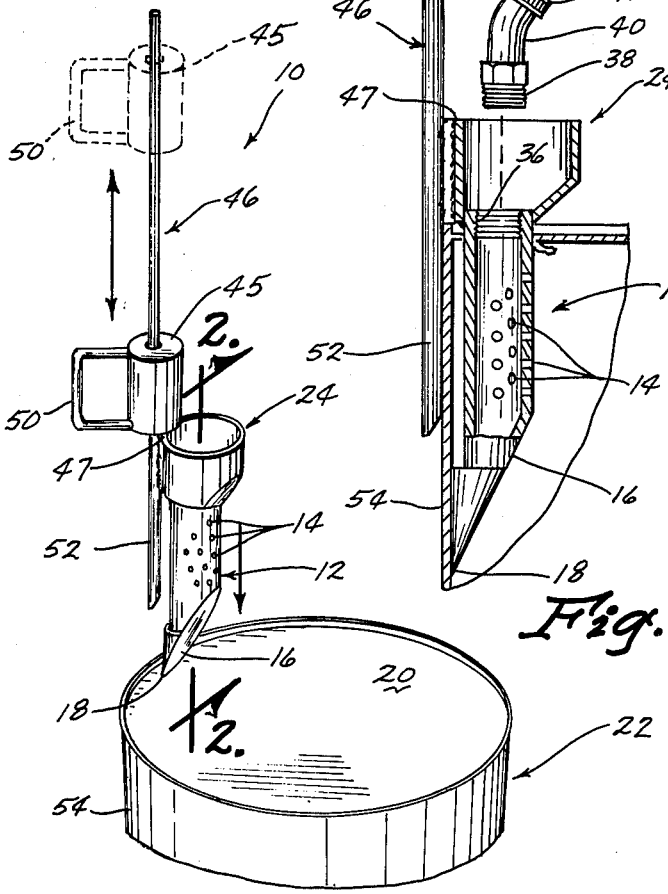
FIG. 1 is a fragmentary perspective view of the puncturing and spray device of this invention positioned for being mounted on the sidewall of a chemical can.

The device for puncturing a hole in a can and washing the inside thereof of this invention is referred to generally in FIG. 1 by the reference numeral 10 and includes an elongated nozzle 12 having spray openings 14 spaced apart along its length and around its outer sidewall. The lower end of the nozzle is closed by a tapered wall 16 terminating at its bottom end in a knife edge 18 for puncturing the end wall 20 of a chemical can 22.

A cylindrical shaped funnel 24 is provided on the upper end of the nozzle 12 and receives the spout 26 of a wash container 28 having a washing solution 30 therein for being emptied into the funnel 24 and being sprayed out through the nozzle spray openings 14. The container holds a predetermined quantity of wash solution sufficient to wash the interior of the chemical can 22.

An alternate wash solution supply may be a hose 32 which may be connected to the upper end of the nozzle 12 within the funnel 24 since the inside wall of the nozzle includes threads 36 for engagement with the threaded hose coupling 38 on an elbow 40 in turn connected to a threaded connector 42 which is connected to the threaded end 44 of the hose 32. Optionally, the hose threaded end 44 could be connected directly to the threads 36 in the upper end of the nozzle 12.

The pointed end 18 of the nozzle 12 is driven through the end wall 20 of the chemical can 22 by a weight 45 slidably mounted on a guide-rod standard 46 being driven against a striking surface 47 on the upper end of the funnel 24, as seen in FIG. 1. The center of gravity of the weight 45 is substantially coplanar with the pointed end 18 and thus substantially all of the force from the weight 45 is directed to the pointed end 18 for puncturing the end wall 20. A handle 50 is provided on the weight 45 for raising and lowering the weight on the standard 46, as seen by the solid and dash lines in FIG. 1. The weight may be dropped or may be driven down against the striking surface 47 by the operator.

The lower end of the standard 46 functions as a guide 52 which is parallel to the nozzle 12 and closely spaced therefrom to provide an opening in which the sidewall 54 of the can 22 is received, as seen in FIGS. 2–5, thereby maintaining the nozzle in parallel alignment with the sidewall 54 of the chemical can 22 during the puncturing and washing operations.

Figure 2:
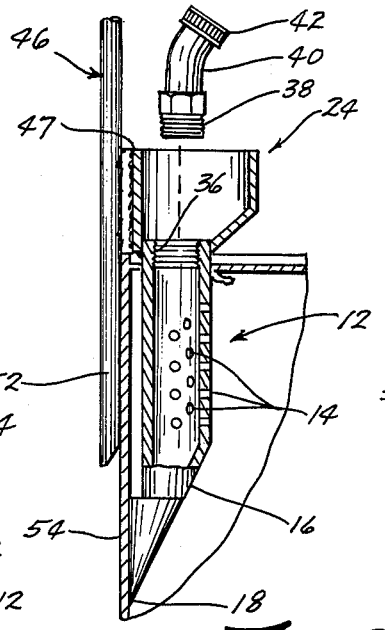
FIG. 2 is a side elevation view thereof taken along line 2—2 in FIG. 1 and showing the nozzle after it has punctured the end wall of the chemical can.
Figure 3:
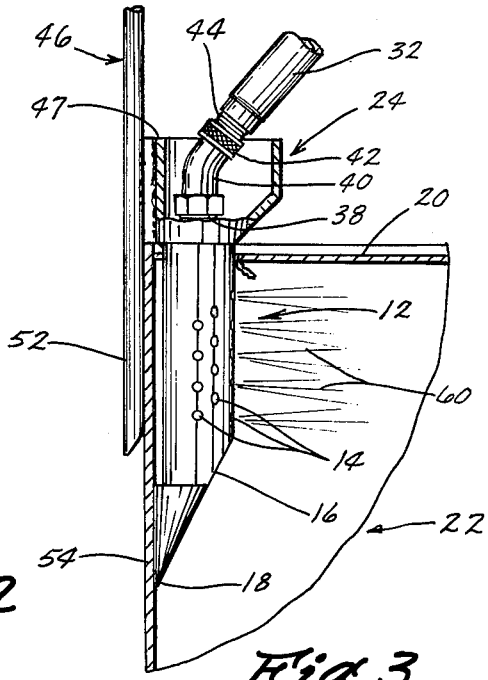
FIG. 3 is a side elevation view similar to FIG. 2 but showing a hose connected to the nozzle within a funnel on the upper end thereof.
Figure 4:
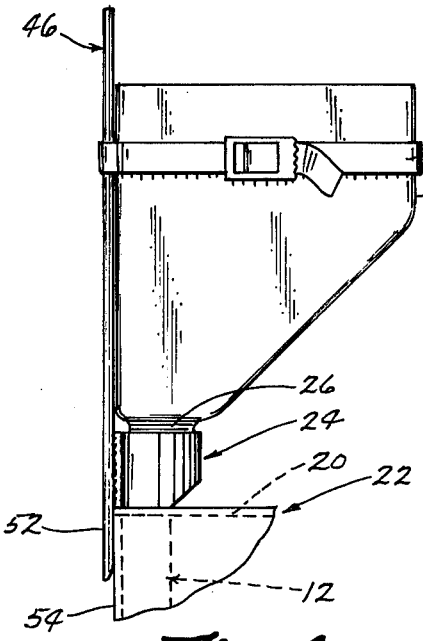
FIG. 4 is a side elevational view similar to FIG. 2 but showing a wash container connected to the funnel for supplying a washing solution to the spray nozzle.
Figure 5:
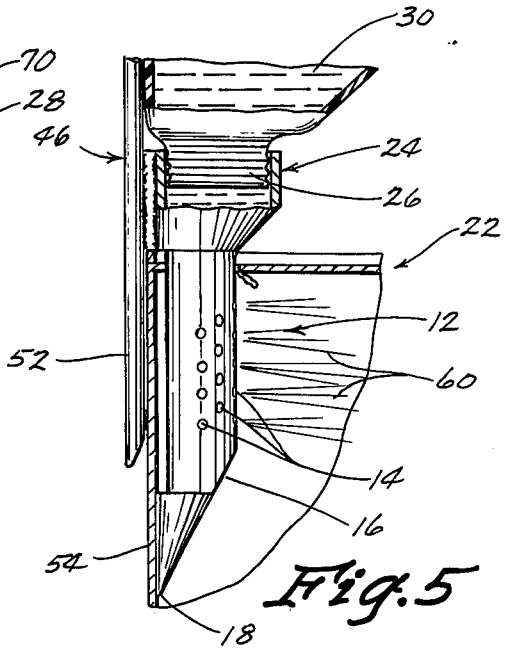
FIG. 5 is an enlarged side elevation view showing the spout of the wash container in the funnel.

In operation the chemical can 22 is placed on end, as seen in FIG. 1, with the bottom of the can up and the pointed end 18 of the nozzle 12 is placed closely adjacent the sidewall 54 and the weight 45 is raised to the dashline position as seen in FIG. 1, and then allowed to drop or is forced down against the striking surface 47 whereupon the pointed end punctures the top wall 20 of the bottom end of the can while also driving the body of the nozzle 12 down into the inside of the can 22, as seen in FIG. 2. Now the spray openings 14 are within the interior of the can for spraying a cleaning solution 60, as seen in FIG. 3, onto the interior sidewalls. The guide rod 52 engages the exterior surface of the can wall 54 and thus maintains the device in an upright position throughout the washing operation. A wash container 28 may be placed with the spout end 26 in the funnel 24 and the container secured to the upstanding guide rod standard 46 by a strap 70 after the weight 45 has been removed from the standard. Optionally, the hose 32 may be connected to the nozzle 12 through the hose connectors 38, 40 and 42. As the interior of the can is being sprayed its contents are emptied into the spray tank and fully utilized in the spraying operation without any waste or pollution of the environment.

I claim:

1. A device for puncturing a hole in a can and washing the inside of the can comprising, an elongated nozzle having opposite ends, one of said ends having a pointed portion for puncturing a hole in a can and the other end having an opening for communication with a liquid source, said one end having spray openings for spraying the inside of a can and said pointed portion being offset from the axial center of said nozzle, a striking surface on the other end of said nozzle offset from the axial center of said nozzle to expose said opening, and said pointed portion and said striking surface being substantially coplanar and being parallel to the axial center of said nozzle, an elongated guide standard connected to said nozzle and extending parallel to said nozzle, and a weight movably positioned on said guide standard for being driven against said striking surface to drive said pointed end of said nozzle through the wall of a can.

2. The structure of claim 1 wherein said spray openings are spaced apart along the length of said nozzle and around the outer peripheral surface for spraying liquid around the substantial interior of a can.

3. The structure of claim 1 wherein said opening in the other end of said nozzle is in communication with a funnel connected to said nozzle.

4. The structure of claim 3 and a wash container having an empting spout is positioned with its spout in said funnel.

5. The structure of claim 4 wherein connecting means is provided connecting said container to said standard.

6. The structure of claim 5 and a hose connecting means is positioned in said funnel for connecting a hose to said nozzle.

7. The structure of claim 1 wherein said standard is further defined as a rod and said weight is cylindrical with an axial opening through which said rod extends.

8. The structure of claim 7 wherein said weight includes a handle for moving said weight along said rod.

9. A device for puncturing a hole in a can and washing the inside of the can comprising, an elongated nozzle having opposite ends, one of said ends being pointed for puncturing a hole in a can and the other end having an opening for communication with a liquid source, said one end having spray openings for spraying the inside of a can, a striking surface on the other end of said nozzle, an elongated guide standard connected to said nozzle and extending parallel to said nozzle, with a portion of said guide standard positioned in close parallel spaced relationship to said nozzle along a portion of the length of said nozzle whereby the side wall of a can is received between said nozzle and said guide member for maintaining said nozzle parallel to said can sidewall, and a weight movably positioned on said guide standard for being driven against said striking surface to drive said pointed end of said nozzle through the wall of a can.

* * * * *